United States Patent [19]

Johne et al.

[11] 4,040,347

[45] Aug. 9, 1977

[54] INKING ARRANGEMENT FOR PRINTING MACHINE

[75] Inventors: Hans Johne, Radebeul; Arndt Jentzsch, Coswig; Gunter Schumann, Radebeul; Roland Reichenberger, Radebeul; Horst Kesselring, Radebeul; Karl-Heinz Fischer, Coswig, all of Germany

[73] Assignee: Veb Polygraph Leipzig Kombinat Fur Polygraphische Maschinen Und Ausrustungen, Leipzig, Germany

[21] Appl. No.: 704,916

[22] Filed: July 13, 1976

[30] Foreign Application Priority Data

July 28, 1975 Germany ..... 187499

[51] Int. Cl.[2] ..... B41F 31/14

[52] U.S. Cl. ..... 101/349; 101/DIG. 14

[58] Field of Search ..... 101/DIG. 14, 348, 349, 101/350, 353, 205, 206, 207, 208

[56] References Cited

U.S. PATENT DOCUMENTS

| | | | |
|---|---|---|---|
| 638,747 | 12/1899 | North | 101/DIG. 14 |
| 738,821 | 9/1903 | Lindner | 101/DIG. 14 |
| 1,282,466 | 10/1918 | Saborsky | 101/DIG. 14 |
| 1,291,068 | 1/1919 | Miehle | 101/DIG. 14 |
| 1,464,925 | 8/1923 | Dudley | 101/348 |
| 3,916,791 | 11/1975 | Simeth | 101/141 |

FOREIGN PATENT DOCUMENTS

| | | | |
|---|---|---|---|
| 1,081,371 | 8/1967 | United Kingdom | 101/DIG. 14 |

*Primary Examiner*—J. Reed Fisher
*Attorney, Agent, or Firm*—Michael J. Striker

[57] ABSTRACT

A printing machine has a plurality of rubbing rollers which are rotatable about respective rubbing axes and serve to transfer ink to a form roller. Each of these rubbing rollers is connected via a link to a respective cam follower engaging in a respective continuous circumferential cam groove in a cam that rotates about an axis parallel to the roller axis. The cam follower is normally nonrotatable about the cam but its angular position about the cam can be adjusted so as to closely control the inking characteristic of the respective rubbing roller. The angular position of each rubbing roller is determined by means of a calculator which is set up to hold a diagram on which is plotted the inking density of the material to be printed against the form roller position. A plurality of sliders each corresponding to a respective rubbing roller are independently displaceable on the support adjacent the diagram and each carry indicia indicating the inking characteristic of the respective rubbing roller. These sliders are adjusted for the desired inking characteristic and then each rubbing roller is adjusted so that it is at the angular position indicated by the respective pointer on the respective slider relative to a scale on the calculator support.

10 Claims, 3 Drawing Figures

43
21
44
24
0
60
120
180
240
300
360°
45
22
22
22
23

INKING ARRANGEMENT FOR PRINTING MACHINE

CROSS-REFERENCE TO RELATED APPLICATIONS

This application is related to the copending and commonly assigned U.S. Pat. applications Nos. 600,571 and 668,923, respectively filed 31 July 1975 and 2 Feb. 1976.

BACKGROUND OF THE INVENTION

The present invention relates to a printing machine. More particularly this invention concerns an arrangement for axially reciprocating the rubbing rollers of the inking mechanism in a printing machine.

A printing machine is known having a plurality of inking rollers which distribute ink or the like from a supply through so-called rubbing rollers onto an impression or form roller or cylinder that itself prints on the paper or similar workpiece to be printed. Since the inking density of material to be printed varies over the length of the material to be printed and since the printing or form roller or cylinder is normally provided with an axially extending groove that takes on no ink, it is necessary to spread the ink on this form roller in such a manner as to achieve the most uniform possible printing results.

It has been suggested in this context to axially reciprocate the rubbing rollers in order to best distribute the ink on the form cylinder in the most efficient manner. To this end the axially reciprocal rubbing rollers may be connected, for instance to a hydraulic arrangement which reciprocates all of them synchronously. In such an arrangement it is possible to vary the stroke and the speed of reciprocation, but not the angular phase of the rubbing rollers relative to the form roller. Thus, such an arrangement makes it impossible to achieve carefully controlled printing results.

It has also been suggested to provide a cam control arrangement which reciprocates the rubbing rollers. Such an arrangement has the disadvantage that the ink distribution is sinusoidal and cannot be controlled with any degree of accuracy.

Further arrangements have been suggested to synchronize the axial reciprocation of the rubbing rollers relative to the form roller. Such arrangements, however, do not allow the machine to be set up to achieve particular printing results, as all of the rollers work together and there is virtually no manner to determine exactly what inking characteristic will be obtained.

Various prior-art printing arrangements are shown in U.S. Pat. No. 3,345,941, British Pat. No. 828,825, and German published specification No. 2,228,939.

SUMMARY OF THE INVENTION

It is therefore an object of the present invention to provide an improved printing machine.

Another object is to provide such a machine which can be set up so as to achieve virtually any desired ink distribution on the form roller.

Yet another object is the provision of such a machine which can be readily adjusted even by a relatively inexperienced operator.

These objects are attained according to the present invention in a printing machine wherein each rubbing roller is associated with a respective cam rotatable about a cam axis generally parallel to the roller axis and forms a continuous circumferential radially open cam groove crossing a plane perpendicular to the cam axis. A cam follower nonrotatably about the cam axis but displaceable parallel thereto is engaged in the groove and axially nondisplaceable in the groove so that the cam follower cannot shift from side to side in the groove. Means is provided for rotating the cam and thereby reciprocating the follower parallel to the cam axis and a coupling is provided between the cam follower and the rubbing roller for displacing the rubbing roller along its axis in synchronism with the displacement of the follower parallel to the cam axis.

The drive means for the cam and the drive means for the rubbing roller are interconnected and connected to the drive for the former roller so that the angular positions of all of these elements are constant once established.

According to yet another feature of this invention adjustment means is provided for angularly displacing the follower about the cam axis and for locking it in any of a multiplicity of angularly offset positions therearound. To this end the cam follower may be provided on a support or holding element carrying an array of gear teeth centered on the cam axis and meshing with a gear connected to a control knob. Thus this control knob can set the angular position of the cam follower and thereby determine the phase position of the rubbing roller relative to the phase position of the form roller.

In accordance with another feature of this invention the cam groove is a peripheral spiral cut in the cam and the follower is a small roller snugly received in this uniform-width groove. The holding element for the follower is carried on one end of a two-arm lever that is pivoted on the machine housing and connected at its other end via an axial coupling to the respective rubbing roller. Thus, a smooth and continuous displacement of the rubbing roller is insured, and the position at which the rubbing roller will reach one end of its reciprocation and return can be established by the adjustment mechanism. In accordance with this invention the rubbing roller is rotated at an angular speed which is twice that at which the cam is rotated so that the two nodes in the cam groove, which are 180° angularly offset from each other, will coincide at the same angular position of the respective rubbing roller since this rubbing roller rotates through 360° each time the cam rotates through 180°.

According to yet another feature of this invention a support is provided on which may be displayed a diagram plotting inking intensity of material to be printed against the form roller position. A plurality of sliders are independently displaceable on the support adjacent this diagram and each carrying indicia indicating inking characteristic of a respective rubbing roller. Thus it is possible to move the sliders so as to align the changeover locations corresponding to the cam node with portions of the material to be printed which need a high ink intensity, or between portions of the material to be printed. In accordance with this invention each of these sliders is provided with a pointer that cooperates with a scale on the support that indicates the angular position of the rubbing rollers. In this manner it is possible to determine the proper positioning of the various cam-adjustment means and thereafter to operate the respective adjustment knobs in order to set the printing machine up for the inking characteristics which is necessary for the particular matter to be printed. Such an arrangement is extremely flexible so that virtually any desired inking characteristic can be obtained, and the more rubbing rollers the machine has the greater the adjustment flexibility.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompaying drawings.

SPECIFIC DESCRIPTION OF A PREFERRED EMBODIMENT

Figure 1:
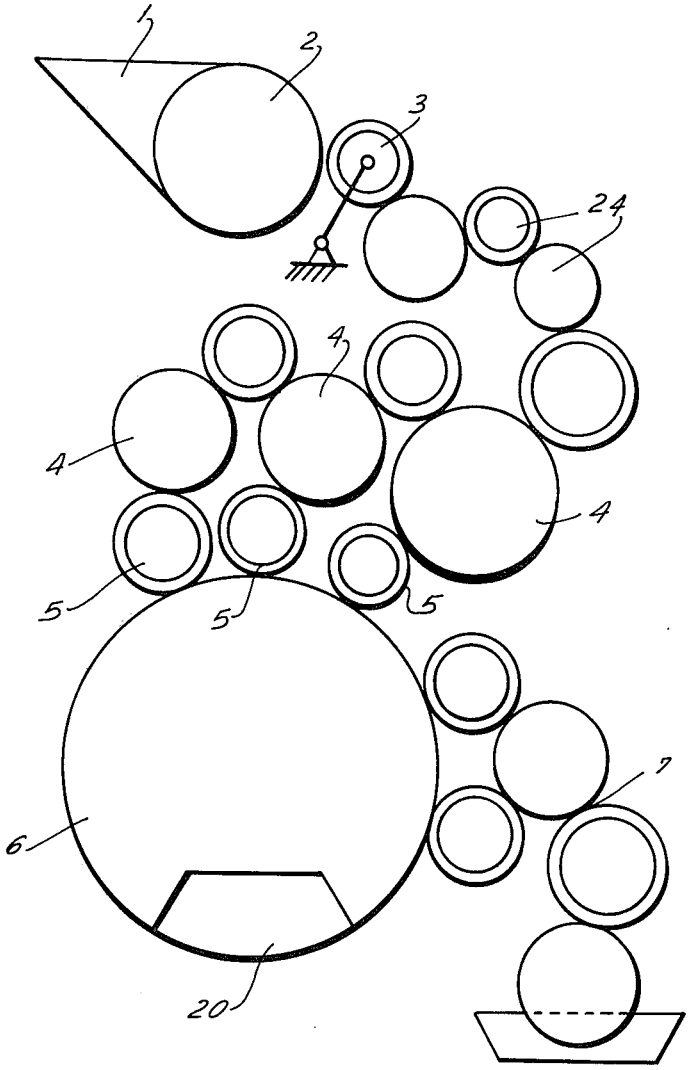
FIG. 1 is a diagrammatic side view of a printing machine according to this invention.

As shown in FIG. 1 ink from a supply 1 is applied to a main inking roller 2 and therethrough by means of a distributing roller 3 to a multiplicity of inking rollers 24 that transfer the ink to rubbing rollers 4 that press against further transfer rollers 5 themselves riding on an impression or form roller 6 having an axial groove 20. Moistening rollers 7 are also provided for use in an offset process.

Figure 2:
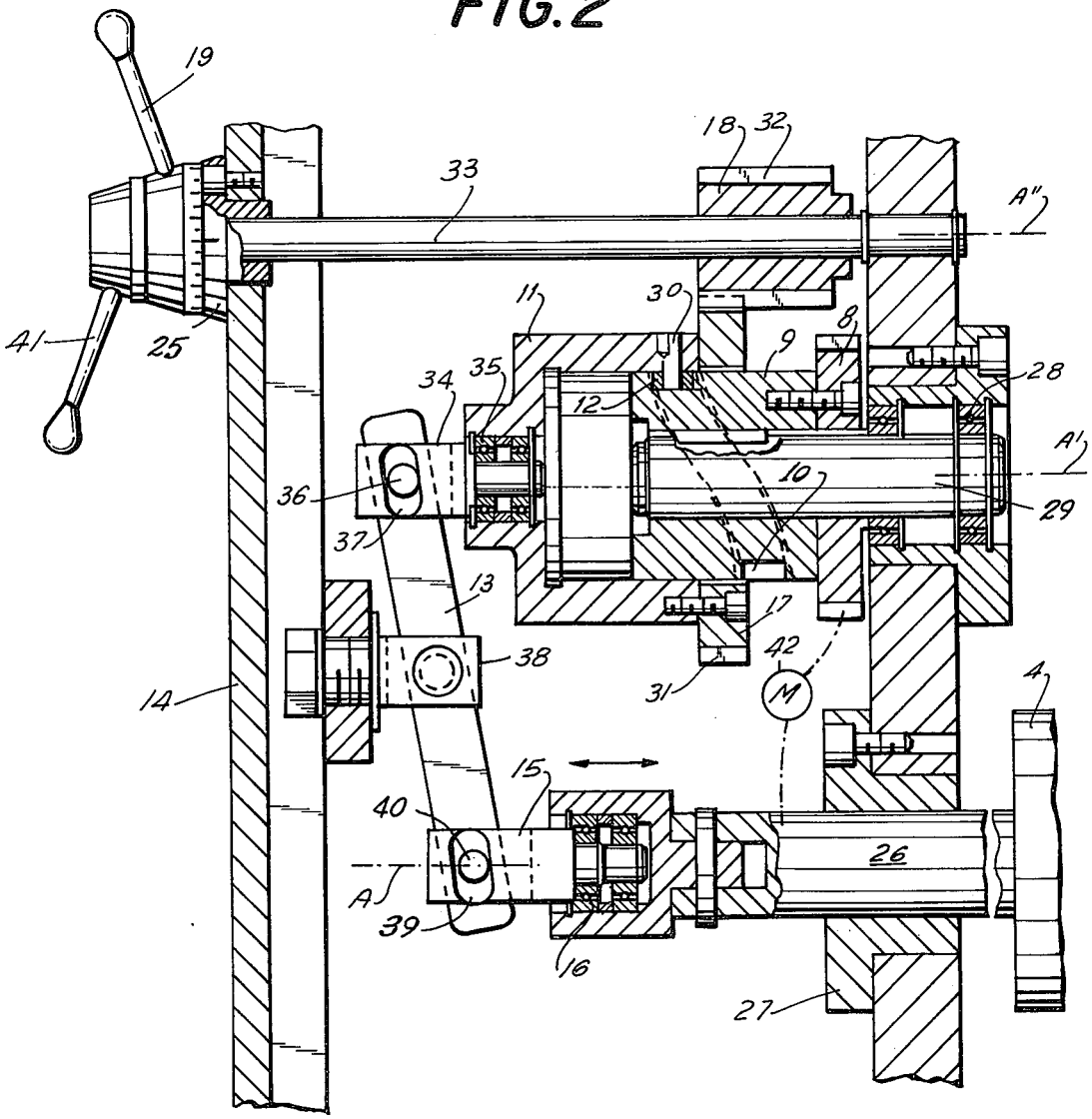
FIG. 2 is an axial section taken through one of the adjustment arrangements according to the present invention.

As better shown in FIG. 2 each of the rollers 4 has a shaft 26 journalled in a housing 27 of the machine and rotatable therein about an axis A. A bearing 28 supports another shaft 29 rotatable about an axis A′ parallel to the axis A in the housing 27. Keyed to this axially nondisplaceable shaft 29 is a cam 9 formed with a rectangular-section helical groove 10 in which snugly fits a roller 12 rotatable about a pin 30 perpendicular to the axis A′ in a cam-follower cup 11. The cup 11 carries a gear 17 having teeth 31 meshing with the teeth 32 of a pinion 18 carried on a shaft 33 also rotatable in the housing 17 about an axis A″ parallel to the axes A and A′. Thus this cup 11 can be rotated about the axis A′ by means of the pinion 18 but is normally arrested so as to be non-rotatable about this axis A′.

A pin 34 secured by means of a bearing 35 in the cup 11 has a transverse pin 36 engaging in a slot 37 formed in one end of a two-armed lever 13 pivoted at 38 on the housing 14 and having a slot 39 in its other end in which engages a pin 40 carried on another shaft 15 secured by means of an axial thrust-bearing 16 in the shaft 26 of the respect roller 4.

The shaft 33 carries at its end an adjustment lever 19 and a locking lever 41. The housing 14 also carries a fixed scale 25 alignable with a marker whose position can be adjusted with the lever 19.

Thus with the system according to the present invention it is possible by rotating the shaft 33 to determine the angular position which the cam follower roller 12 will have about the axis A′. This angular position determines the axial position of the roller 4.

A drive motor 42 is operatively connected to a gear 8 bolted to the cam 9 and to the shaft 26 and functions so as to rotate the shaft 26 at an angular velocity V and to rotate the shaft 29 about its axis A′ at an angular velocity equal to V/2. Since the cam groove 10 has a pair of switchover regions in which the axial displacement of the follower cup 11 will stop, this rotation of this cam 9 at half speed will mean that for each full rotation of the respective roller 4 its axial displacement will only stop once. Such stopping will, therefore, always occur at the same angular position of the respective roller 4.

It is noted that each of the rollers 4 has its own such arrangement as shown in FIG. 2 for independent adjustment.

Figure 3:
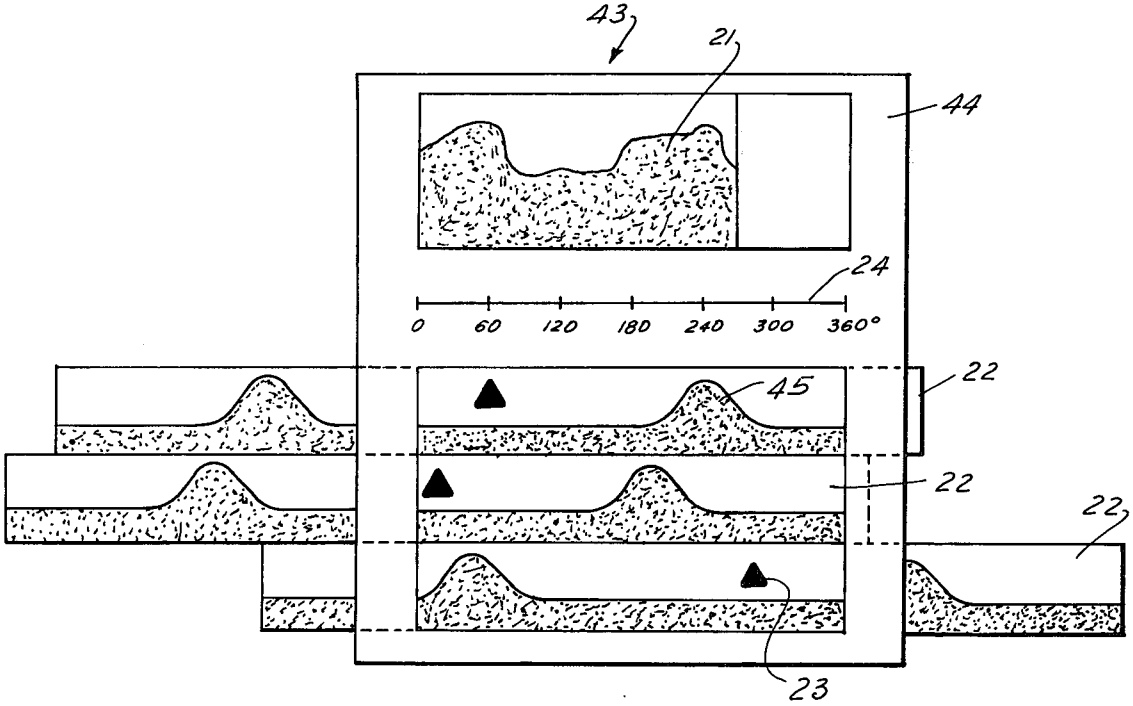
FIG. 3 is a front elevational view of the apparatus for establishing the proper positioning for the various rubbing rollers of the press of FIG. 1.

FIG. 3 shows an inking calculator 43 which has a support 44 adapted to carry a diagram 21 which is a plot of the integral of the inking density along the form roller 6. The chart 21 shown therefore can be seen to have two regions of relatively heavy inking, corresponding to regions on the material to be printed which carry a lot of print, a dark picture or the like.

The support 44 also carries three sliders 22 each corresponding to a respective rubbing roller 4 and each having a bump 45 corresponding to that angular position along the respective roller where the greatest inking will occur. This bump 45 therefore is the position at which the axial rubbing of the roller will stop so that considerable ink transfer will take place. In addition each of the sliders 22 carries a pointer 23 alignable with the scale 24 on the support 44.

In use the diagram 21 is clipped in place and then the bumps 45 are aligned with the regions of greatest density. Thereupon the user ascertains for each roller the position along the scale 24 assumed by the respective pointer 23 and sets the corresponding lever 19 with reliance on the scale 25. It is possible in this manner to set the press up for most efficient inking for the particular job. Such setup is, in addition, extremely simple so that even a relatively unskilled worker can quickly carry it out.

It will be understood that each of the elements described above, or two or more together, may also find a useful application in other types of machine differing from the types described above.

While the invention has been illustrated and described as embodied in a inking device for printing apparatus, it is not intended to be limited to the details shown since various modifications and structural changes may be made without departing in any way from the spirit of the present invention.

Without further analysis the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a printing machine, the combination comprising:

a rubbing roller having a roller axis and axially displaceable therealong;

a cam rotatable about a cam axis generally parallel to said roller axis and formed with a continuous circumferential radially open cam groove crossing a plane perpendicular to said cam axis;

a cam follower nonrotatable about said cam axis but displaceable parallel thereto and engaged axially nondisplaceably in said groove;

cam and roller drive means for synchronously rotating said cam and roller respectively about said cam and roller axes and thereby reciprocating said follower parallel to said cam axis;

coupling means connected between said follower and said rubbing roller for displacing same along said roller axis in synchronism with the displacement of said follower parallel to said cam axis; and means for angularly displacing said follower about said cam axis and for locking it in any of a plurality of angularly offset positions therearound.

2. The combination defined in claim 1 wherein said cam drive means rotates said cam at an angular speed equal substantially to half the angular speed with which said roller drive means rotates said roller.

3. The combination defined in claim 1 wherein said means for angularly displacing includes an array of gear teeth carried on said follower and centered on said cam axis and a gear meshing with said teeth.

4. The combination defined in claim 3, further comprising a gear wheel having said array and coupled to said follower and axially coupled via said follower to said cam.

5. The combination defined in claim 1 wherein said coupling means includes a two-arm lever having a central fixed pivot, one end axially coupled to said follower, and another end axially coupled to said roller.

6. The combination defined in claim 1 wherein said printing machine has a plurality of such rollers each provided with a respective such cam, follower, roller and cam drive means, coupling means, and adjustment means.

7. The combination defined in claim 6, further comprising: a form roller on which ink is spread by said rubbing rollers; a support provided with means for displacing a diagram plotting ink density of material to be printed against form roller position; and a plurality of sliders independently displaceable on said support adjacent said diagram and each carrying indicia indicating the inking characteristic of a respective rubbing roller.

8. The combination defined in claim 7 wherein said support is provided with a scale indicating angular rubbing roller positions.

9. The combintion defined in claim 8 wherein each of said adjustment means is provided with a scale similar to said scale of said support and indicating adjustment position of the respective cam follower.

10. The combination defined in claim 8 wherein each of said sliders is provided with a pointer alignable with said scale.

* * * * *